US005797279A

United States Patent [19]

Osborne

[11] Patent Number: 5,797,279

[45] Date of Patent: Aug. 25, 1998

[54] ORGANIC REFRIGERATION SYSTEM

[76] Inventor: Elaine W. Osborne, 730 Riverside Dr., Apt. 1E, New York, N.Y. 10031

[21] Appl. No.: 799,380

[22] Filed: Feb. 14, 1997

[51] Int. Cl.[6] ..... F25D 25/02

[52] U.S. Cl. ..... 62/381; 62/441

[58] Field of Search ..... 62/381, 441

[56] References Cited

U.S. PATENT DOCUMENTS

| | | | |
|---|---|---|---|
| 2,507,834 | 5/1950 | Storer et al. | 62/381 |
| 2,638,400 | 5/1953 | Spotts | 62/381 |
| 2,722,807 | 11/1955 | Downing | 62/381 |

*Primary Examiner*—Ronald C. Capossela

[57] ABSTRACT

A new Organic Refrigeration System for refrigerating food at an optimum temperature range by taking into account the vertical temperature stratification that develops in a conventional refrigerator. The inventive device includes a refrigerator, a vertical shaft secured within the refrigerator, an upper drum, a middle drum, and a lower drum rotatably secured to the vertical shaft slidably on top of one another forming a cylindrical compartmentalized storage unit. A plurality of storage compartments formed to a syncline shape which removably fit within the drums for storing produce.

8 Claims, 3 Drawing Sheets

ORGANIC REFRIGERATION SYSTEM

BACKGROUND OF THE INVENTION

1. Field of the Invention

The present invention relates to Refrigeration Devices and more particularly pertains to a new Organic Refrigeration System for refrigerating food at an optimum temperature range by taking into account the vertical temperature stratification that develops in a conventional refrigerator.

2. Description of the Prior Art

The use of Refrigeration Devices is known in the prior art. More specifically, Refrigeration Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Refrigeration Devices include U.S. Pat. No. 5,277,488; U.S. Pat. No. 4,123,130; U.S. Pat. No. 5,044,704; U.S. Pat. No. 5,411,328; U.S. Pat. No. 5,277,039 and U.S. Design Pat. No. 265,202.

While these devices fulfill their respective, particular objectives and requirements, the aforementioned patents do not disclose a new Organic Refrigeration System. The inventive device includes a refrigerator, a vertical shaft secured within the refrigerator, an upper drum, a middle drum, and a lower drum rotatably secured to the vertical shaft slidably on top of one another forming a cylindrical compartmentalized storage unit.

In these respects, the Organic Refrigeration System according to the present invention substantially departs from the conventional concepts and designs of the prior art, and in so doing provides an apparatus primarily developed for the purpose of refrigerating food at an optimum temperature range by taking into account the vertical temperature stratification that develops in a conventional refrigerator.

SUMMARY OF THE INVENTION

In view of the foregoing disadvantages inherent in the known types of Refrigeration Devices now present in the prior art, the present invention provides a new Organic Refrigeration System construction wherein the same can be utilized for refrigerating food at an optimum temperature range by taking into account the vertical temperature stratification that develops in a conventional refrigerator.

The general purpose of the present invention, which will be described subsequently in greater detail, is to provide a new Organic Refrigeration System apparatus and method which has many of the advantages of the Refrigeration Devices mentioned heretofore and many novel features that result in a new Organic Refrigeration System which is not anticipated, rendered obvious, suggested, or even implied by any of the prior art Refrigeration Devices, either alone or in any combination thereof.

To attain this, the present invention generally comprises a refrigerator, a vertical shaft secured within the refrigerator, an upper drum, a middle drum, and a lower drum rotatably secured to the vertical shaft slidably on top of one another forming a cylindrical compartmentalized storage unit.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Organic Refrigeration System apparatus and method which has many of the advantages of the Refrigeration Devices mentioned heretofore and many novel features that result in a new Organic Refrigeration System which is not anticipated, rendered obvious, suggested, or even implied by any of the prior art Refrigeration Devices, either alone or in any combination thereof It is another object of the present invention to provide a new Organic Refrigeration System which may be easily and efficiently manufactured and marketed.

It is a further object of the present invention to provide a new Organic Refrigeration System which is of a durable and reliable construction.

An even further object of the present invention is to provide a new Organic Refrigeration System which is susceptible of a low cost of manufacture with regard to both materials and labor, and which accordingly is then susceptible of low prices of sale to the consuming public, thereby making such Organic Refrigeration System economically available to the buying public.

Still yet another object of the present invention is to provide a new Organic Refrigeration System which provides in the apparatuses and methods of the prior art some of the advantages thereof, while simultaneously overcoming some of the disadvantages normally associated therewith.

Still another object of the present invention is to provide a new Organic Refrigeration System for refrigerating food at an optimum temperature range by taking into account the vertical temperature stratification that develops in a conventional refrigerator.

Yet another object of the present invention is to provide a new Organic Refrigeration System which includes a refrigerator, a vertical shaft secured within the refrigerator, an upper drum, a middle drum, and a lower drum rotatably secured to the vertical shaft slidably on top of one another forming a cylindrical compartmentalized storage unit.

Still yet another object of the present invention is to provide a new Organic Refrigeration System wherein each storage compartment has a marking system which takes into account the vertical temperature stratification that would tend to develop inside the unit, thereby enabling each variety of produce to be stored at its optimum temperature range.

Even still another object of the present invention is to provide a new Organic Refrigeration System that stores produce in a more organized manner providing easy access to selected foods.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
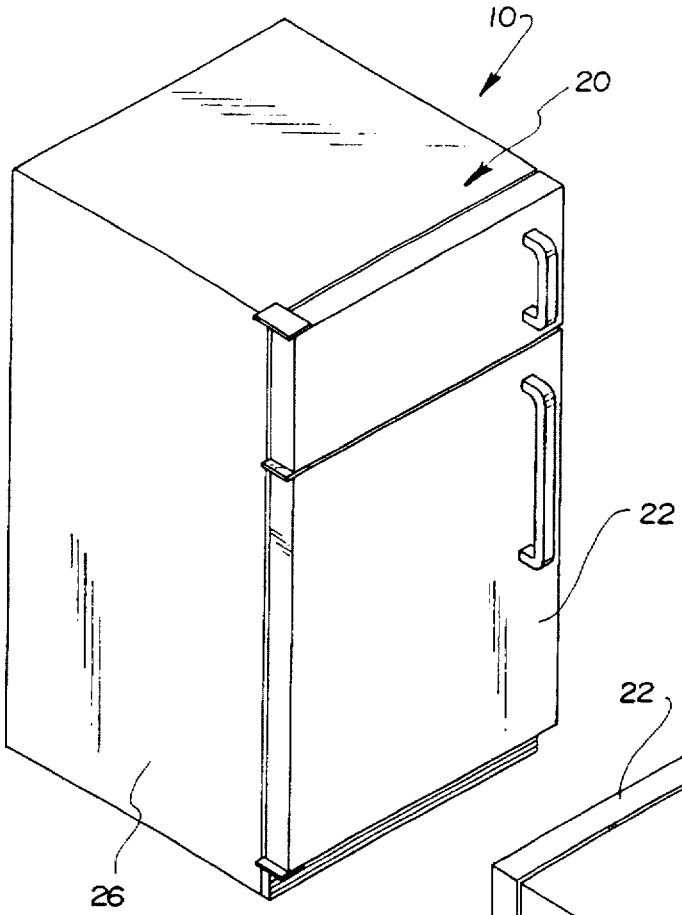
FIG. 1 is a front upper perspective view of a new Organic Refrigeration System according to the present invention.
Figure 2:
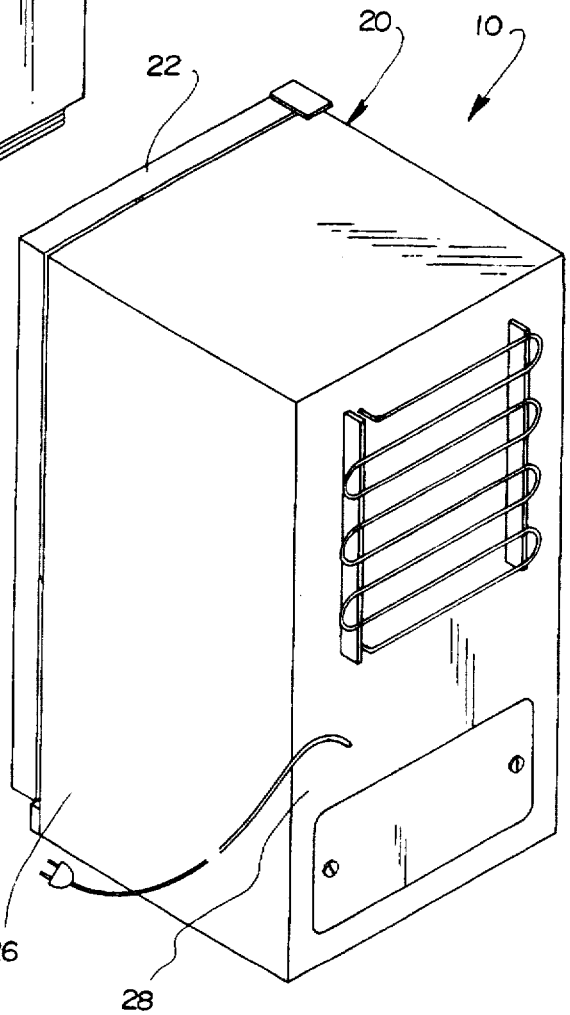
FIG. 2 is a rear upper perspective view of the present invention.

With reference now to the drawings, and in particular to FIGS. 1 through 6 thereof, a new Organic Refrigeration System embodying the principles and concepts of the present invention and generally designated by the reference numeral 10 will be described.

More specifically, it will be noted that the Organic Refrigeration System 10 comprises a refrigerator 20 having a ceiling 21, a door 22, sidewalls 26, a floor 29 and a rear wall 28 defining an inner cavity. A vertical shaft 30 is secured vertically within the inner cavity concentrically. A plurality of compartmentalized drums 40, 50 and 60 are rotatably secured along the vertical shaft 30 forming a rotatable vertical structure. The compartmentalized drums include a plurality of vertical partitions 44 which form syncline sections 42. A plurality of storage compartments 70 are formed to removably fit within the syncline sections 42 for storing unnumbered food as best shown in FIG. 5 of the drawings.

Figure 4:
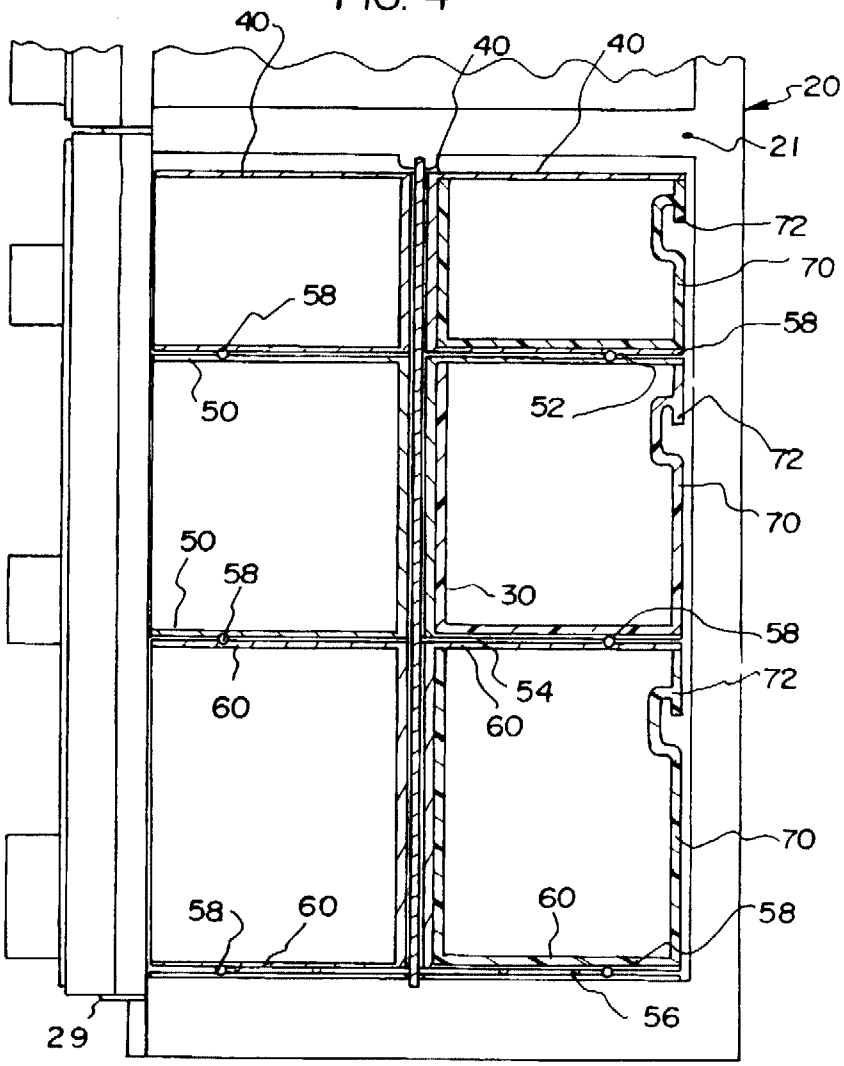
FIG. 4 is a cross sectional view taken along line 4—4 of FIG. 3.
Figure 3:
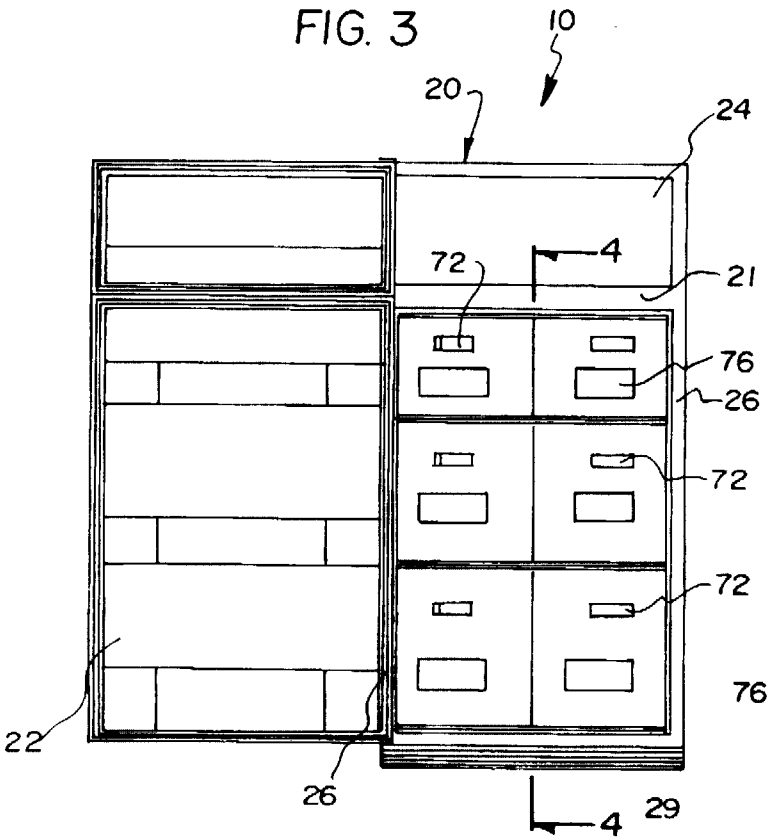
FIG. 3 is a front view of the present invention with the door open.
Figure 5:
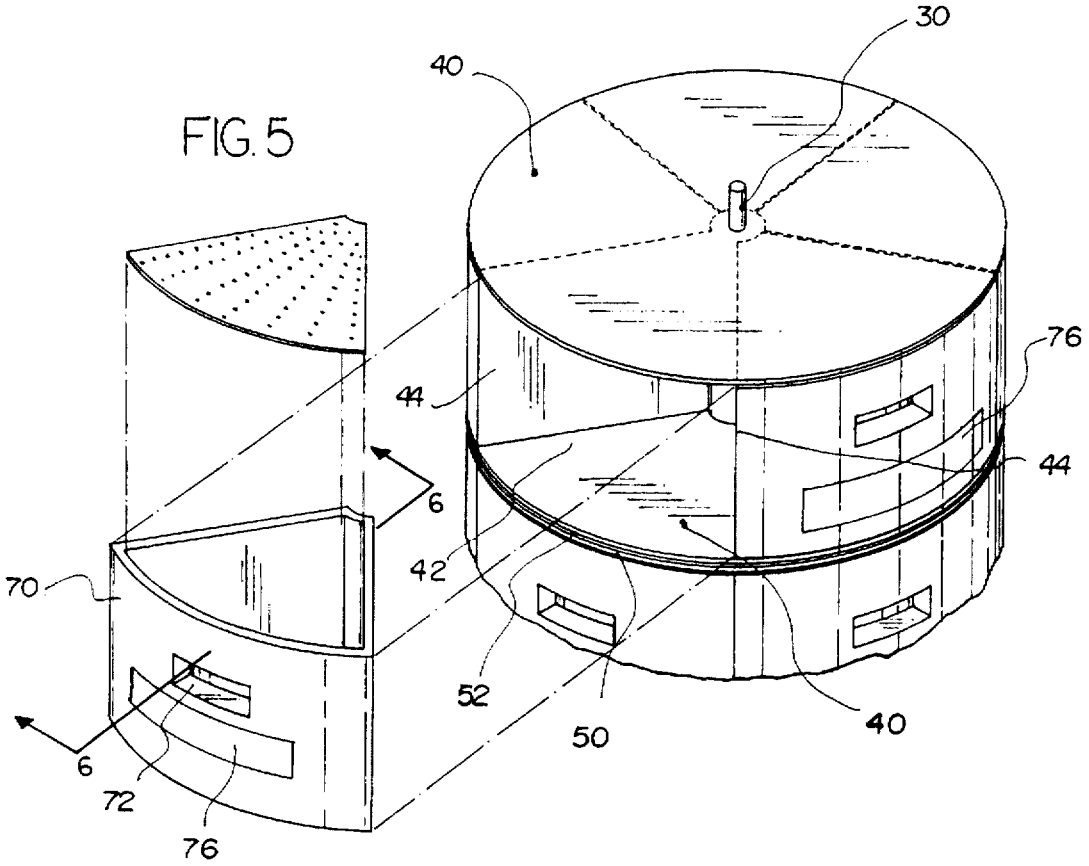
FIG. 5 is a magnified upper side perspective view of the drums and storage compartments.
Figure 6:
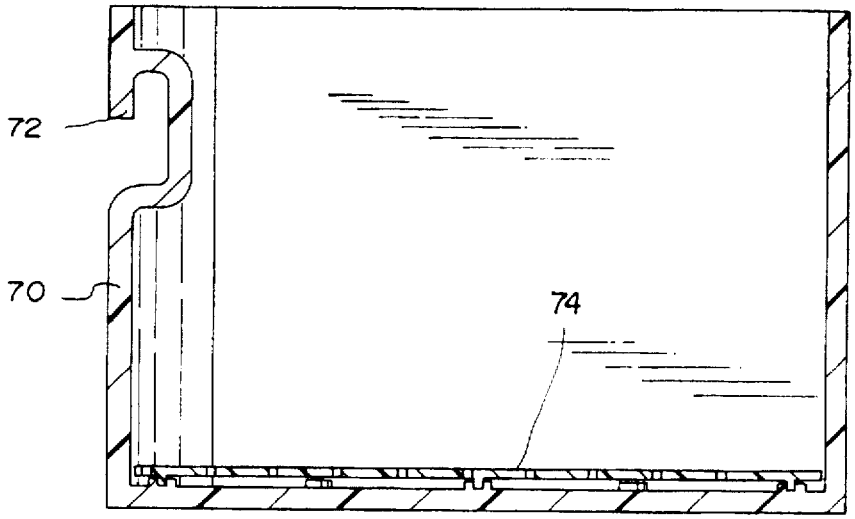
FIG. 6 is a cross sectional view taken along line 6—6 of FIG. 5.

As best shown in FIGS. 3 through 5 of the drawings, the compartmentalized drums comprise an upper compartmentalized drum 40 having a bottom surface and rotatably secured about the vertical shaft 30. A upper disc 52 having a plurality of ball bearings 58 is secured to the vertical shaft 30 juxtaposed to the bottom surface of the upper compartmentalized drum 40 for supporting the upper compartmentalized drum 40 and for allowing the upper compartmentalized drum 40 to rotate about the vertical shaft 30. A middle compartmentalized drum 50 has a bottom surface and a top surface and is rotatably secured about the vertical shaft 30. The top surface of the middle compartmentalized drum 50 is rotatably juxtaposed to the upper disc 52 opposite of the upper compartmentalized drum 40. A middle disc 54 has a plurality of ball bearings 58 secured to the vertical shaft 30 juxtaposed to the bottom surface of the middle compartmentalized drum 50 for supporting the middle compartmentalized drum 50 and for allowing the middle compartmentalized drum 50 to rotate about the vertical shaft 30. A lower compartmentalized drum 60 has a bottom surface and a top surface and is rotatably secured about the vertical shaft 30. The top surface of the lower compartmentalized drum 60 is rotatably juxtaposed to the middle disc 54 opposite of the middle compartmentalized drum 50. A lower disc 56 has a plurality of ball bearings 58 secured to the vertical shaft 30 juxtaposed to the bottom surface of the lower compartmentalized drum 60 for supporting the lower compartmentalized drum 60 and for allowing the lower compartmentalized drum 60 to rotate about the vertical shaft 30. As shown in FIGS. 5 and 6 of the drawings, the storage compartment 70 is syncline shaped for removably being positioned within the syncline sections 42. A handle 72 is preferably secured to the storage compartment 70 allowing easy access to the unnumbered food within. An aerating plate 74 is removably juxtaposed to a bottom surface of the storage compartment 70 for keeping the unnumbered food within fresh and crisp. A label 76 is secured to a front surface of the storage compartment 70 allowing labeling of the type of unnumbered food within the storage compartment 70. The storage compartments 70 are preferably formed from a transparent plastic allowing the user to envision the unnumbered food within the storage compartments 70. A freezer compartment 24 is alternatively included within the refrigerator 20 above the ceiling 21 as shown in FIGS. 1 through 4 of the drawings.

In use, a selected storage compartment 70 within a selected compartmentalized drum 40, 50 or 60 is pulled out by the user grasping the handle 72. The selected unnumbered food is removed from within the selected storage compartment 70 and any remaining unnumbered food is left within the selected storage compartment 70 for later use. The storage compartment 70 is repositioned within the selected compartmentalized drum 40, 50 or 60 where the unnumbered food is kept fresh and crisp by the aerating plate 74 allowing air to circulate within the storage compartment 70 about the unnumbered food.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A refrigeration system comprising:

a refrigerator having a ceiling, a door, sidewalls, a floor and a rear wall defining an inner cavity;

a vertical shaft secured vertically within said inner cavity concentrically;

a plurality of compartmentalized drums rotatably secured along said vertical shaft forming a rotatable vertical structure;

a plurality of discs, each disc having a plurality of ball bearings secured to said vertical shaft, said discs being positioned such that a bottom of each compartmentalized drum is positioned adjacent to a respective one of said discs, said discs being for supporting said adjacent compartmentalized drum and for allowing said adjacent compartmentalized drum to rotate about said vertical shaft;

said compartmentalized drums include a plurality of vertical partitions which form wedge-shaped sections; and a plurality of storage compartments formed to removably fit within said wedge-shaped sections for storing food.

2. The refrigeration system of claim 1, wherein said storage compartment is wedge shaped for removably being positioned within said wedge-shaped sections.

3. The refrigeration system of claim 1, including:

a handle secured to said storage compartment;

an aerating plate removably juxtaposed to a bottom surface of said storage compartment; and a label secured to a front surface of said storage compartment allowing labeling of the type of food within said storage compartment.

4. The refrigeration system of claim 1, wherein said storage compartments are formed from a transparent plastic.

5. A refrigeration system comprising:

a refrigerator having a ceiling, a door, sidewalls, a floor and a rear wall defining an inner cavity:

a vertical shaft secured vertically within said inner cavity concentrically;

a plurality of compartmentalized drums rotatable secured along said vertical shaft forming a rotatable vertical structure;

said compartmentalized drums include a plurality of vertical partitions which form substantially wedge-shaped sections;

a plurality of storage compartments formed to removably fit within said wedge-shaped sections for storing food; and wherein said compartmentalized drums include an upper compartmentalized drum having a bottom surface and rotatably secured about said vertical shaft;

a upper disc having a plurality of ball bearings secured to said vertical shaft juxtaposed to said bottom surface of said upper compartmentalized drum for supporting said upper compartmentalized drum and for allowing said upper compartmentalized drum to rotate about said vertical shaft;

a middle compartmentalized drum having a bottom surface and a top surface and is rotatably secured about said vertical shaft;

said top surface of said middle compartmentalized drum is rotatably juxtaposed to said upper disc opposite of said upper compartmentalized drum;

a middle disc having a plurality of ball bearings secured to said vertical shaft juxtaposed to said bottom surface of said middle compartmentalized drum for supporting said middle compartmentalized drum and for allowing said middle compartmentalized drum to rotate about said vertical shaft;

a lower compartmentalized drum having a bottom surface and a top surface and is rotatably secured about said vertical shaft; said top surface of said lower compartmentalized drum is rotatably juxtaposed to said middle disc opposite of said middle compartmentalized drum; and a lower disc having a plurality of ball bearings secured to said vertical shaft juxtaposed to said bottom surface of said lower compartmentalized drum for supporting said lower compartmentalized drum and for allowing said lower compartmentalized drum to rotate about said vertical shaft.

6. The refrigeration system of claim 5, wherein said storage compartment is wedge shaped for removably being positioned within said wedge-shaped sections.

7. The refrigeration system of claim 6, including:

a handle secured to said storage compartment;

an aerating plate removably juxtaposed to a bottom surface of said storage compartment; and a label secured to a front surface of said storage compartment allowing labeling of the type of food within said storage compartment.

8. The refrigeration system of claim 7, wherein said storage compartments are formed from a transparent plastic.

* * * * *